US008585256B2

(12) United States Patent
Chen

(10) Patent No.: US 8,585,256 B2
(45) Date of Patent: Nov. 19, 2013

(54) ELECTRICAL ENERGY SUPPLY INDICATOR FOR A HELMET

(76) Inventor: Tsan-Jee Chen, Taipei (TW)

( * ) Notice: Subject to any disclaimer, the term of this patent is extended or adjusted under 35 U.S.C. 154(b) by 143 days.

(21) Appl. No.: 13/412,290

(22) Filed: Mar. 5, 2012

(65) Prior Publication Data

US 2013/0229812 A1 Sep. 5, 2013

(51) Int. Cl.
*F21V 15/00* (2006.01)

(52) U.S. Cl.
USPC ..... 362/362; 362/105; 362/106; 362/107

(58) Field of Classification Search
USPC ..... 362/105–107, 363, 209, 164; 2/105
See application file for complete search history.

(56) References Cited

U.S. PATENT DOCUMENTS 5,845,987 A * 12/1998 Painter ..... 362/206
5,871,271 A * 2/1999 Chien ..... 362/106
6,733,150 B1 * 5/2004 Hanley ..... 362/106
6,908,208 B1 * 6/2005 Hyde et al. ..... 362/105
7,234,831 B1 * 6/2007 Hanley ..... 362/106
7,520,630 B2 * 4/2009 Murphy ..... 362/105
2005/0180129 A1 * 8/2005 Harris ..... 362/105

* cited by examiner

*Primary Examiner* — Anh Mai
*Assistant Examiner* — Elmito Breval
(74) *Attorney, Agent, or Firm* — Ming Chow; Sinorica, LLC

(57) ABSTRACT

An electrical energy supply indicator for a helmet is disclosed to employ a casing having a storage chamber for housing an electrical resistor, a light-emitting diode (LED), a cover plate, a female terminal socket; wherewith the storage chamber has a compartment plate, the female terminal socket has an article locking member, a pin receiving member having four trapezoidal faces, an anode and a cathode for connecting with the resistor and LED. The locking member is immobilized between the compartment plate and an interior surface, the receiving member passes through the receiving channel to connect externally with a male terminal pin. The LED operates to determine if attached electrical circuit is powered. A slant-faced extrusion block is on the underside of the cover plate to superimpose onto the locking member such that the locking member can be more secured inside the casing, thereby preventing undesirable movement of the female terminal socket.

6 Claims, 12 Drawing Sheets

ELECTRICAL ENERGY SUPPLY INDICATOR FOR A HELMET

BACKGROUND OF THE INVENTION

1. Field of the Invention

The present invention relates to an electrical energy supply indicator for use in a helmet, particularly to an apparatus for determining the conductive state of an electrical circuit within an electrical heating wire mesh established within a helmet's visor, said apparatus can fasten the receiving aperture for the electrical energy supply plug, and as a result, said receiving aperture is fixed and will not move about from its original position when the electrical energy supply plug is inserted to cause rotation thereabout.

2. Description of the Prior Art

Currently, some efforts have been made to provide an indicator showing electrical energy supply for use on a helmet, as shown in FIGS. 1A and 1B. An embodiment of the prior art shows an assembly of a casing 11, a cover plate 12, an RCA female terminal socket 13, an electrical resistor 14 and a light-emitting diode 15, wherein the RCA female terminal socket 13 is constructed to pass through the receiving channel 111 of the casing 11, and there is at least one positioning groove 112 on the rim of the receiving channel 111; the RCA female terminal socket 13 has a pin receiving terminal 131 and screw thread 132, wherein the screw thread 132 fastens itself with the aid of a nut 2 into the interior of the casing 11, while also assists the RCA female terminal socket 13 to connect with the electrical resistor 14 and the light-emitting diode 15. Thereafter, the casing 11 can be lockably affixed onto a helmet upon combining with a casing 12 to perform altogether as an indicator for showing the state of electrical energy use by an electrical heating wire mesh upon the helmet's visor. Therefore when the RCA male terminal pin 3 is connected with the RCA female terminal socket 13, the light bulb inside the light-emitting diode 15 will be lit to indicate that the electrical energy is being properly supplied. The RCA male terminal pin 3 has around its perimeter at least one positioning block 31 that works to accommodate a specific positioning groove 112 in such a fashion that when the RCA male terminal pin 3 is inserted into the RCA female terminal pin 13, the positioning block 31 of the RCA male terminal pin 3 can securely interlock with the pitch surface of the positioning groove 112, thereby causing rotational movement of the RCA male terminal pin 3 and fixing the RCA male terminal pin 3 in a stable position within the receiving channel 111.

However, as FIG. 1C discloses, the RCA female terminal 13 can suffer from problems including short-circuit or the like relating to improper electrical circuit connection when rotation of a particular manner of the RCA, such as a one-time rotation or multiple rounds of rotation, of the male terminal pin 3 leads to concurrent movement of the RCA female terminal socket 13. Moreover, incessant rotation of the assembly pieces herein can also lead to breakage or joint disconnection of the cable lines or welding joints, thereby bringing about an undesirable situation where the light-emitting diode 15 will not glow notwithstanding stable electrical energy supply to the circuit. Occurrence of this disadvantage can disable the electrical energy supply indicator to reach the desired outcome, and can also reduce the service life of the indicator.

Therefore, there is a need to overcome this problem as seen in the prior art. An optimal solution for this case will be one that can stabilize the movement of the RCA female terminal socket 13 when the RCA male terminal pin 3 is moving about, as this can avoid disconnection or the like of the RCA male terminal pin 3 with other work piece in the product assembly.

SUMMARY OF THE INVENTION

Accordingly, it is a primary object of the present invention to provide an electrical energy supply indicator for a helmet, where the electrical energy supply indicator can remain functional to accurately show if the electrical heating visor of a helmet is receptive to the provided electrical energy even if the indicator is subject to multiple rotational disturbance from connecting with the male terminal pin.

It is another object of the present invention to provide a helmet-based electrical energy supply indicator, where the female terminal socket will not be subject to a rotational motion even if the male terminal pin is undergoing a rotational movement.

The invention presented herewith to attain the desired goals heretofore includes a storage chamber, a cover plate, a female terminal socket, an electrical resistor and a light-emitting diode (LED), where the storage chamber has a compartment plate, and further, the female terminal socket has an article locking member, a pin receiving member having four trapezoidal faces, an anode terminal and a cathode terminal. The article locking member is sandwiched securely between the compartment plate and an interior surface of the casing. The pin receiving member thereof passes through the receiving channel of the casing to retain an out-of-the-casing position to be connected with a male terminal pin. The electrical resistor and the LED are installed within the storage chamber, where the LED operates to determine the operability of the electrical circuit. The cover plate has a slant-faced extrusion block on its underside, thereby allowing the extrusion block to superimpose onto the article locking member herein in their combined form. In this manner, the article locking member can be more securely fixed in a particular location inside the casing, thereby preventing undesirable movement of the female terminal socket.

Specifically, the aforesaid pin receiving member is a RCA female terminal socket.

Specifically, the aforesaid male terminal pin is a RCA male terminal pin.

Specifically, the aforesaid casing has a receiving channel and an aperture, and the pin receiving member of the female terminal pin is constructed to pass through the receiving channel of the casing, thereby making the pin receiving member to remain in an out-of-the-casing position.

Specifically, the aforesaid light-emitting diode is packaged with a packaging member, and the packaging member herein is performed to traverse through the aperture on the casing.

Specifically, a first terminal of the aforesaid electrical resistor is removably connected to an anode terminal or a cathode terminal, and a second terminal of the electrical resistor herein is removably connected to the light-emitting diode therein.

Specifically, a first terminal of the aforesaid light-emitting diode is removably connected to the electrical resistor, and a second terminal of the light-emitting diode herein is removably connected to an anode terminal therein or a cathode terminal therein.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1A:
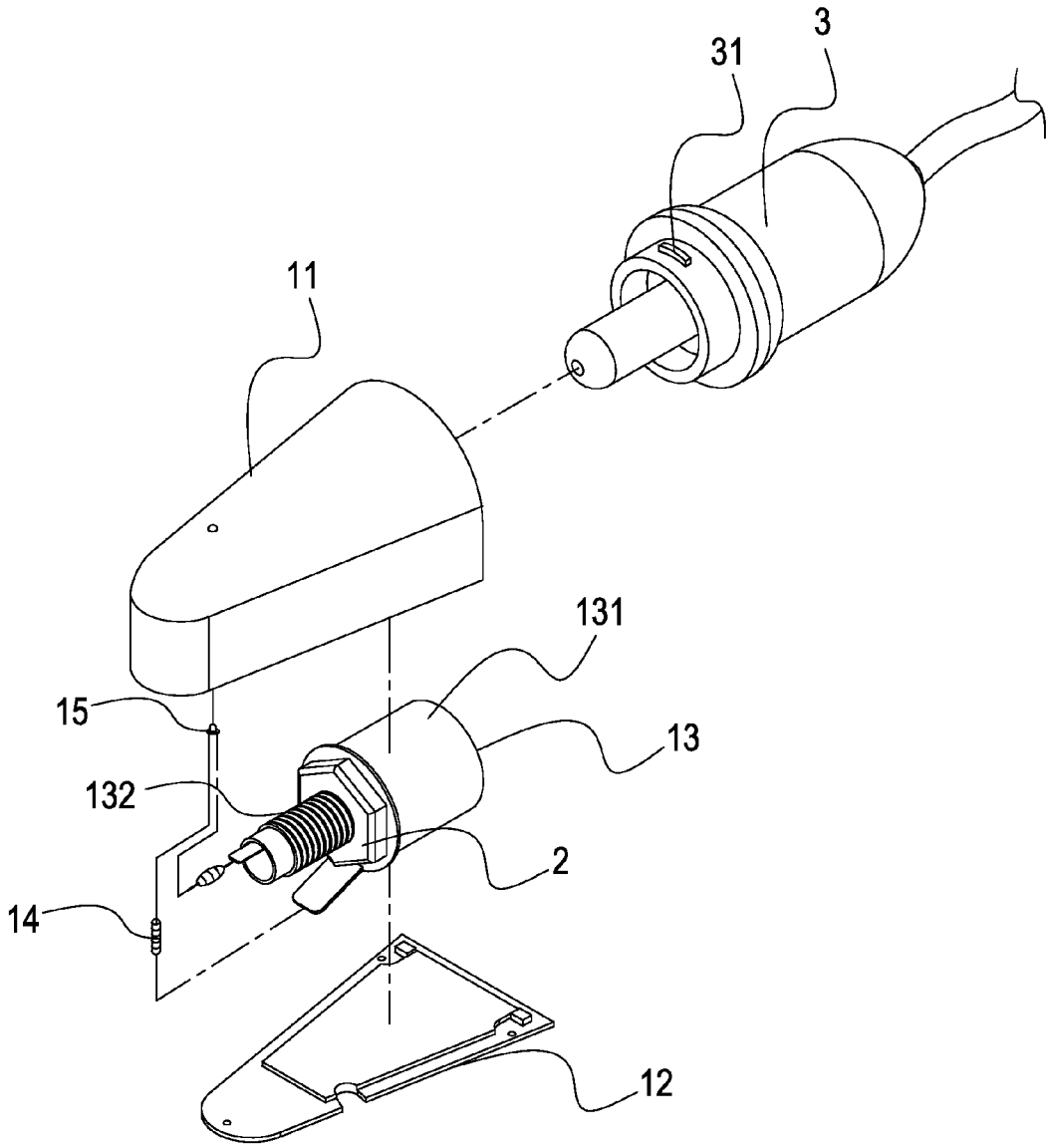
FIG. 1A is an exploded schematic view of an electrical energy supply indicator for helmet constructed as known in the prior art.
Figure 1B:
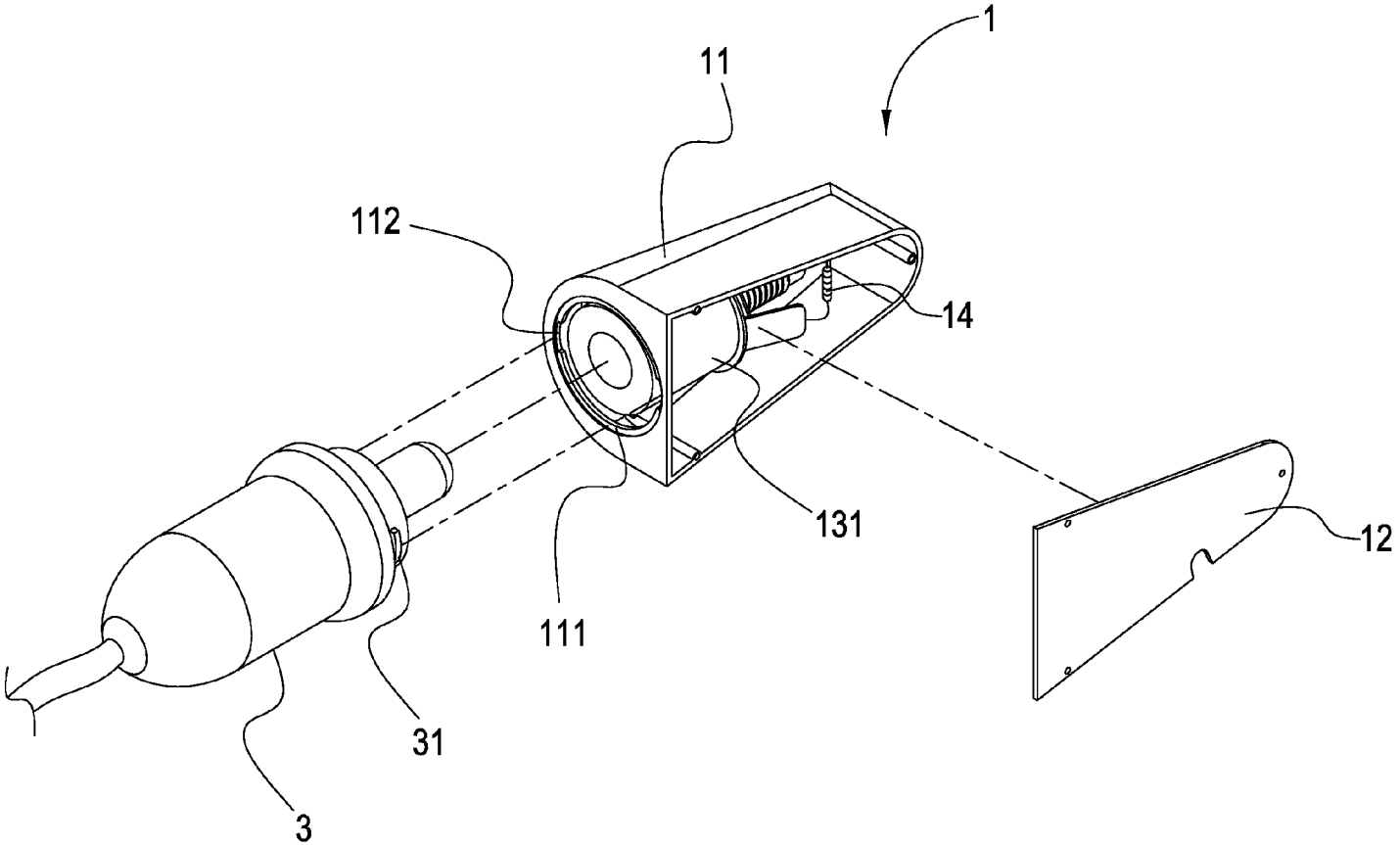
FIG. 1B is an exploded schematic view thereof.
Figure 1C:
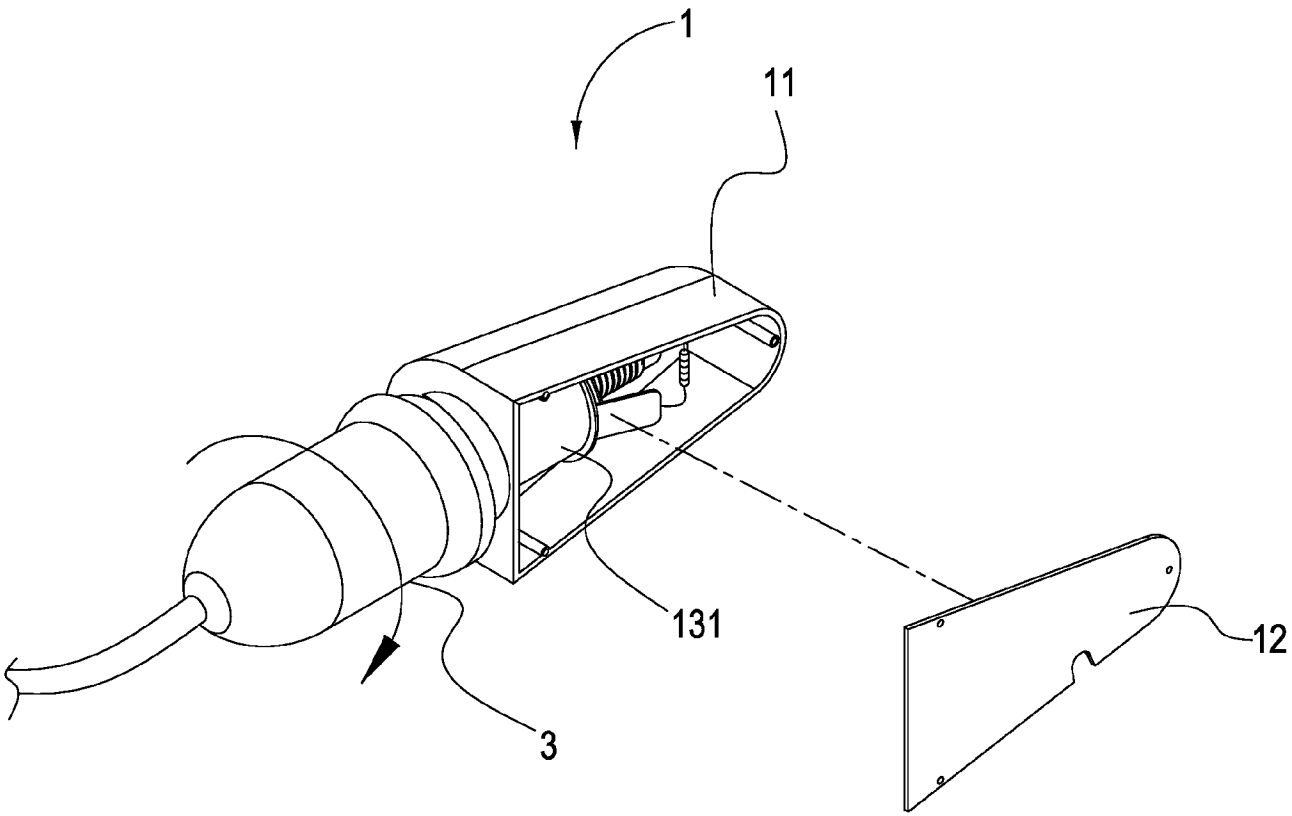
FIG. 1C is an assembled schematic view of thereof.

The particular features and advantages of the invention as well as other objects will become apparent from the following description taken in connection with the accompanying drawings.

Referring now to FIG. 2A, FIG. 2B, FIG. 2C and FIG. 2D, an electrical energy supply indicator for helmet according to the principle of the present invention is disclosed with each in either an exploded schematic view or an assembled schematic view, and it can be known from the figures that an embodiment of the electrical energy supply indicator 4 as disclosed comprises:

a casing 41, which has a storage chamber 411, a receiving channel 412 and an aperture 413, wherein the storage chamber 411 has a compartment plate 414, and there is at least one positioning groove 412 constructed on the periphery of the receiving channel 415;

a female terminal socket 42, which operates to connect with a male terminal socket 5, the female terminal socket 42 has a pin receiving member 421, an article locking member 422 having four trapezoidal faces 4221, an anode terminal 423 and a cathode terminal 424, wherein the pin receiving member 421 of the female terminal socket 42 passes through the receiving channel 412 of the casing 41 to retain an out-of-the-casing position, the article locking member 422 is sandwiched securely between the compartment plate 414 and an interior surface 416 of the casing 41; moreover the female terminal socket is an RCA female terminal socket, and the male terminal pin 5 is an RCA male terminal pin;

an electrical resistor 43, which is located within the storage chamber 411, wherein a terminal of the electrical resistor 43 is removably connected to an anode terminal 423 or a cathode terminal 424, and an opposite terminal of the electrical resistor 43 is removably connected with a light-emitting diode 44;

the light-emitting diode 44, which is located within the storage chamber 411, wherein a first terminal of the light-emitting diode 44 is removably connected to the electrical resistor 43, and a second terminal of the light-emitting diode 44 is removably connected to an anode terminal 423 or a cathode terminal 424; moreover the light-emitting diode 44 is packaged with a packaging member, the packaging member is performed to traverse through an aperture 413 on the casing 41;

a cover plate 45, which operates to removably complete a wall of the casing 41, the cover plate 45 has a slant-faced extrusion block 451 on the underside, the extrusion block 451 of the cover plate 45 operates to superimpose onto a surface of the article locking member 422 with the four trapezoidal faces 4221, thereby allowing the article locking member 422 to be more securely fixed between the compartment plate 414 and the interior surface 416 inside the casing 41, thereby preventing undesirable movement of the female terminal socket 42.

As a result, the casing 41 can be lockably combined with the cover plate 45 to allow affixing onto a helmet, and when the male terminal pin 5 is interconnected with the female terminal socket 42, the light-emitting diode 44 can operate to glow to show that the electrical energy is currently being supplied.

Figure 2A:
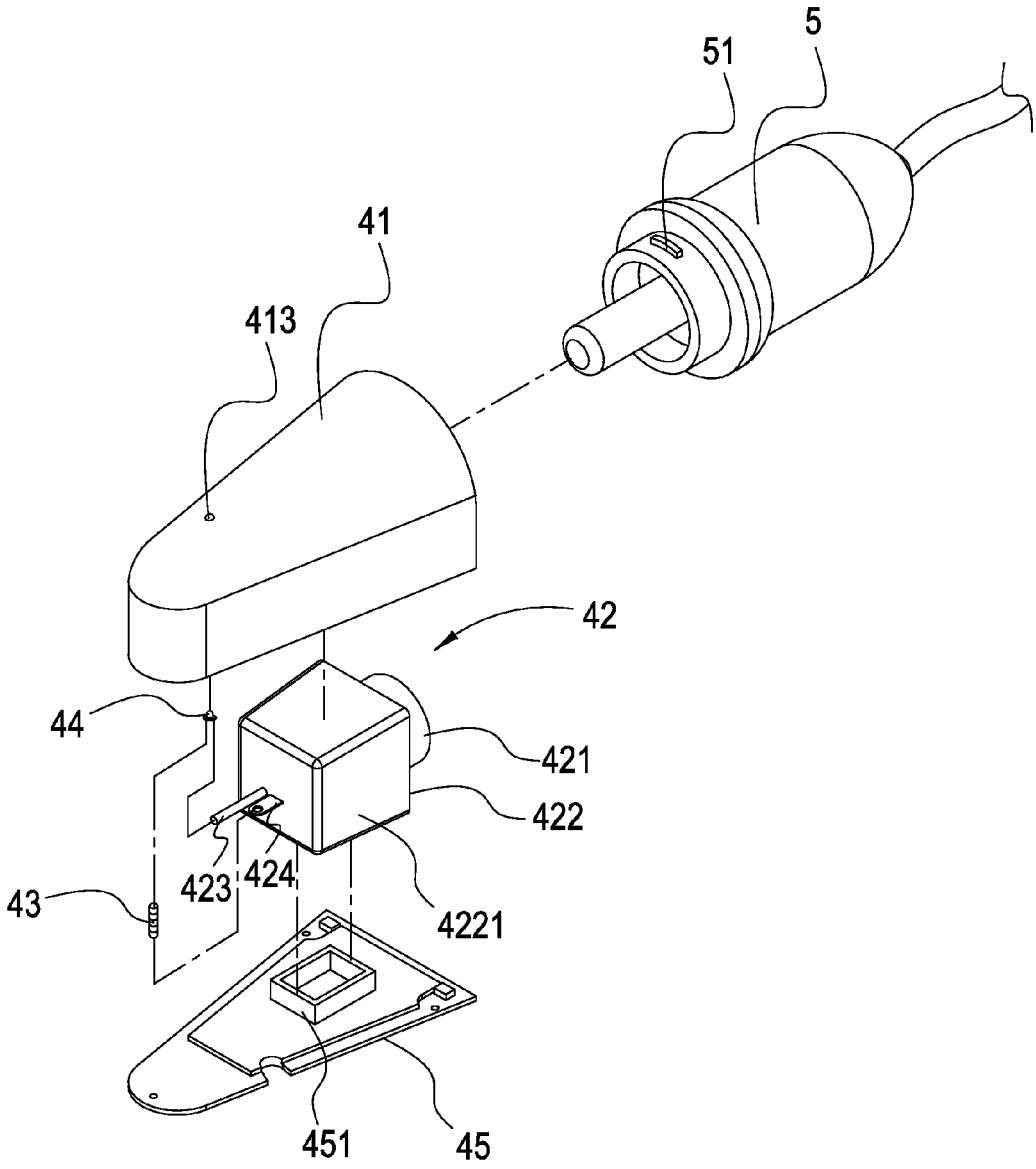
FIG. 2A is an exploded schematic view of an electrical energy supply indicator for helmet constructed in accordance with the principles of the present invention.
Figure 2B:
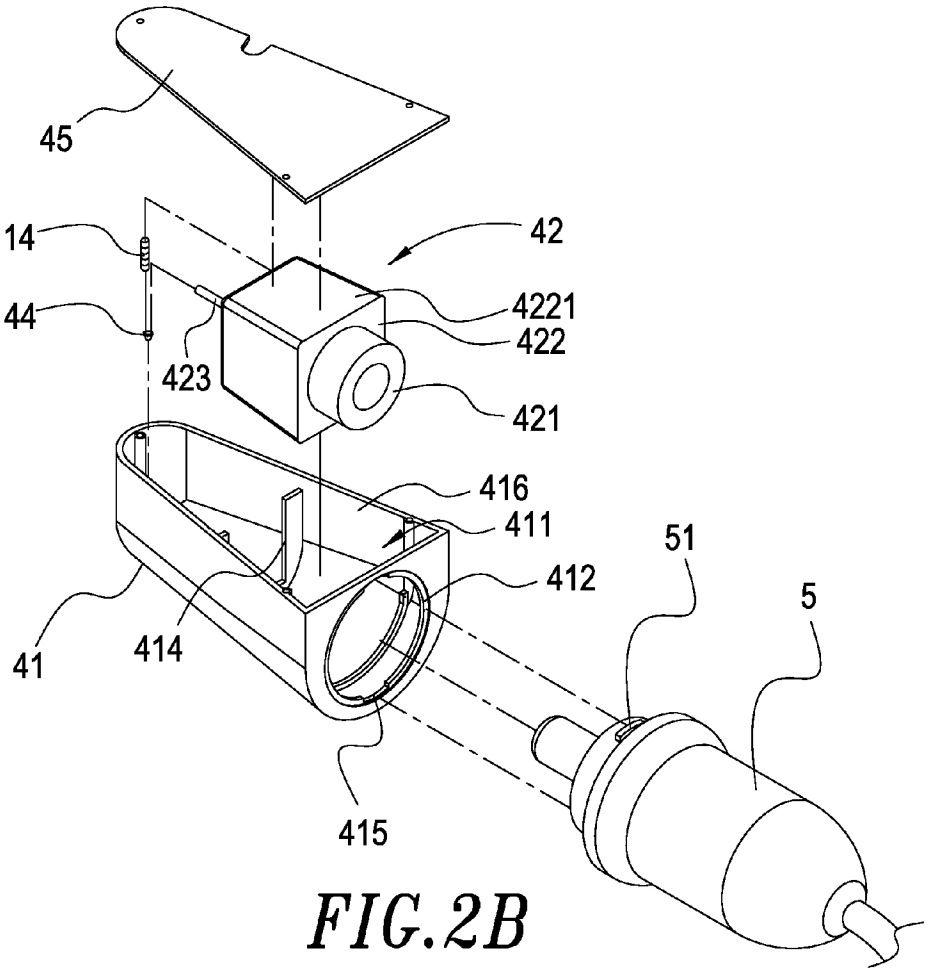
FIG. 2B is an exploded schematic view thereof.
Figure 2C:
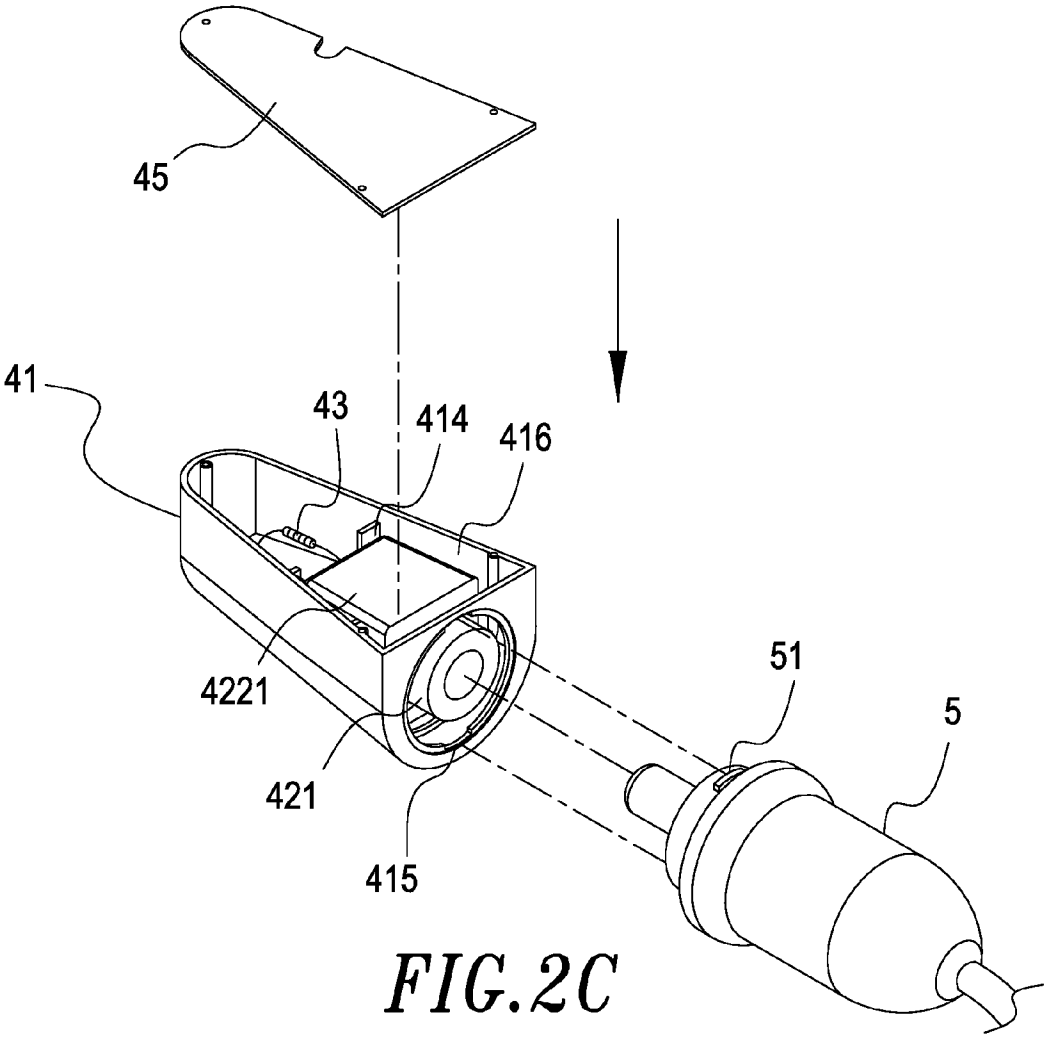
FIG. 2C is an exploded schematic view thereof.
Figure 2D:
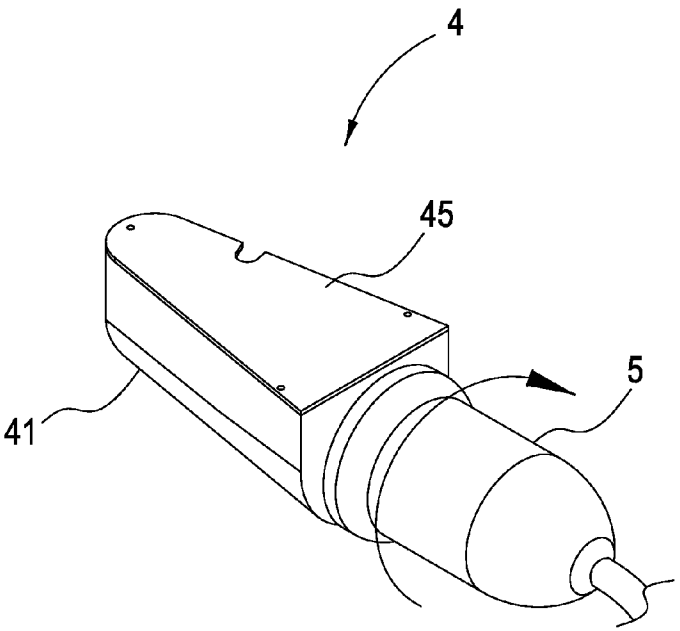
FIG. 2D is an assembled schematic view thereof.
Figure 3A:
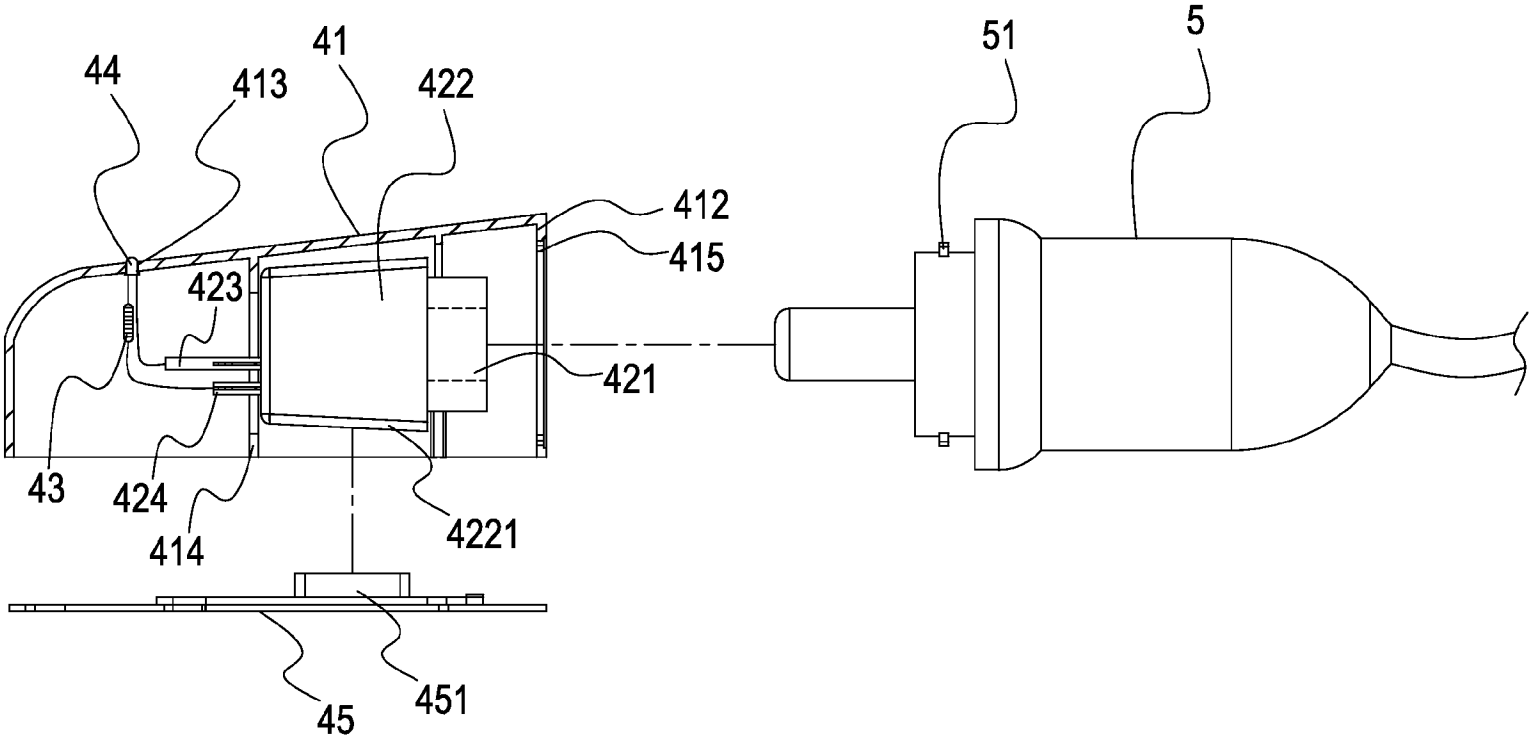
FIG. 3A is an exploded cross-sectional schematic view thereof.
Figure 3B:
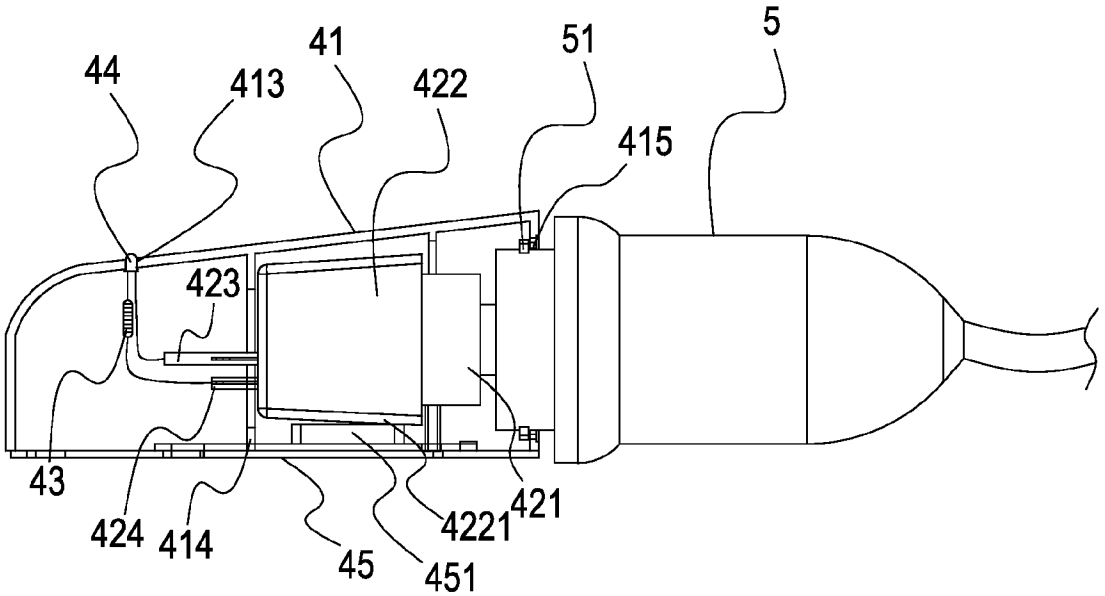
FIG. 3B is an assembled cross-sectional schematic view thereof.

Referring next to FIG. 2B, FIG. 3A and FIG. 3B, an electrical energy supply indicator for helmet according to the principle of the present invention is disclosed with each in an exploded schematic view, an exploded cross-sectional schematic view, or an assembled cross-sectional schematic view, and it can be known from the figures that the male terminal pin 5 has around its perimeter at least one positioning block 51 that works to accommodate a specific positioning groove 415 in such a fashion that when the male terminal pin 5 is inserted into the female terminal pin 42, the positioning block 52 of the male terminal pin 5 can securely interlock with the pitch surface of the positioning groove 415, thereby causing rotational movement of the male terminal pin 5 and fixing the male terminal pin 5 in a stable position within the receiving channel 412 of the casing 41. Moreover, because the article locking member 422 of the female terminal socket 42 will be securely sandwiched between the compartment plate 414 of the casing 41 and the interior surface 416 of the casing 41, the female terminal socket 42 will not be effected to rotate, which thereby avoids disconnection or similar problem at the male terminal socket 5.

Figure 4A:
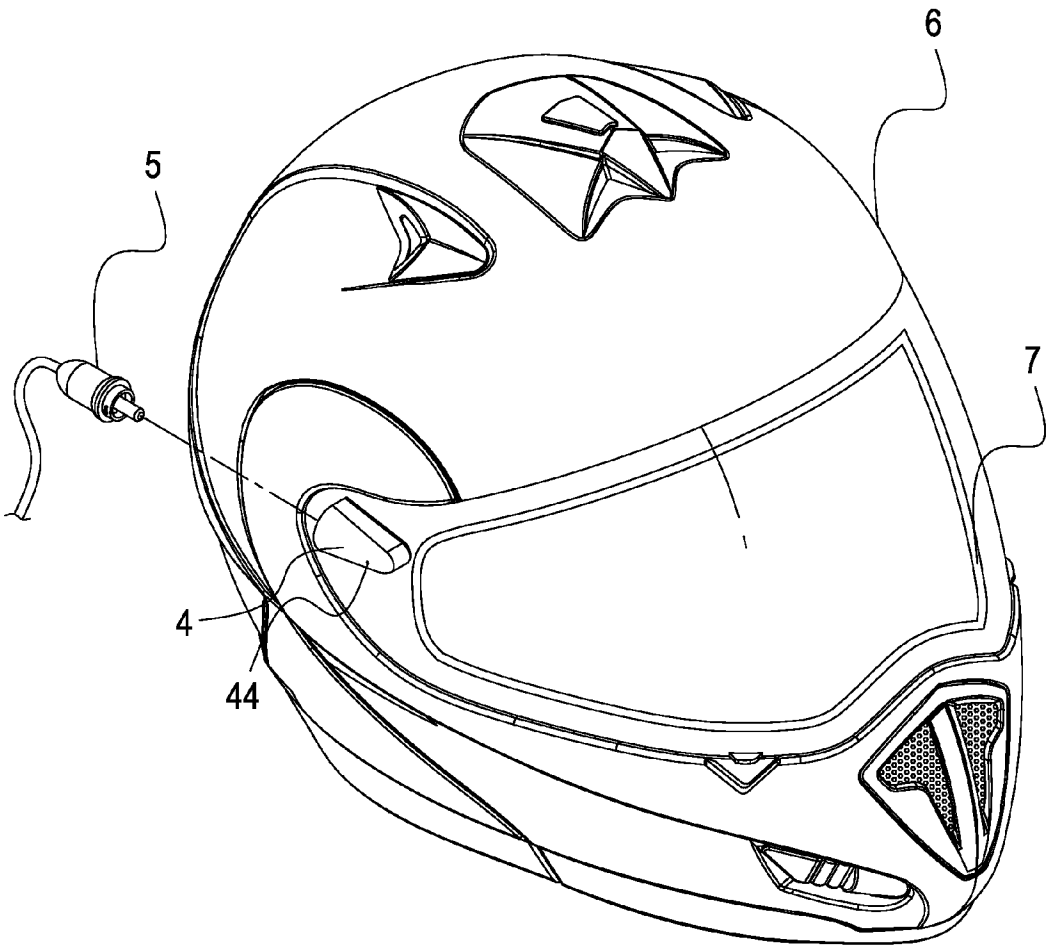
FIG. 4A is a view depicting the manner of inserting an embodiment thereof into a socket on a helmet's surface.
Figure 4B:
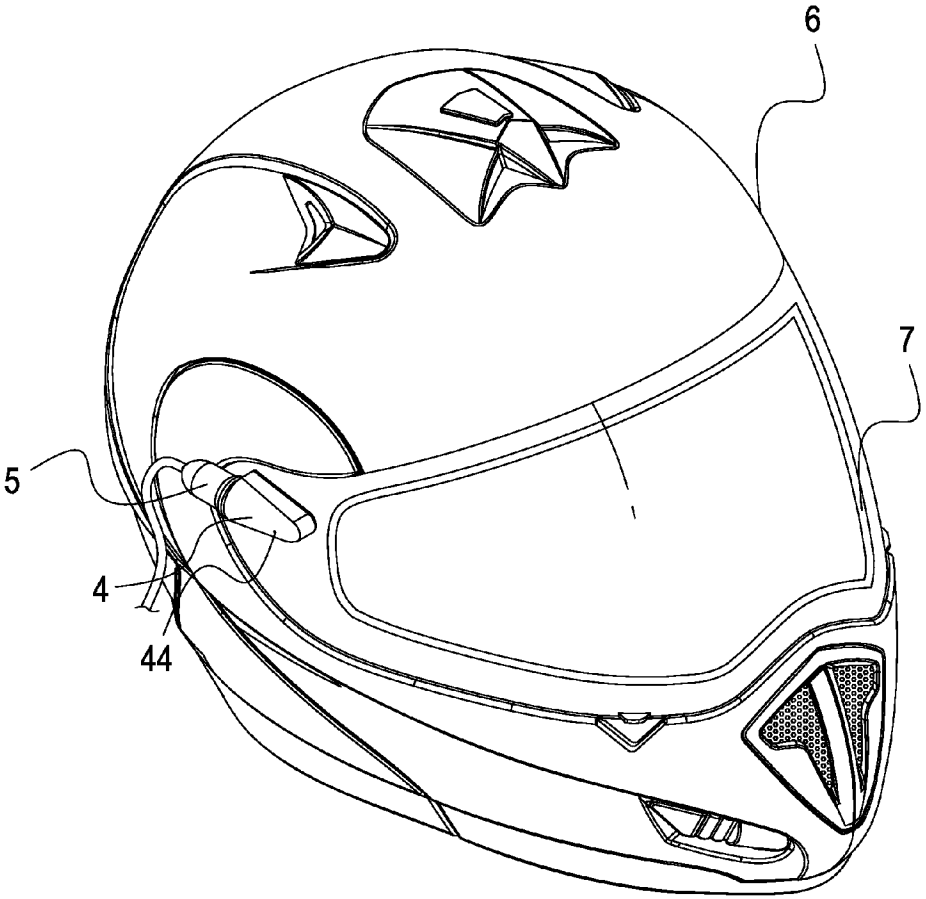
FIG. 4B is a view illustrating an embodiment thereof mounted within a socket on a helmet's surface.
Figure 4C:
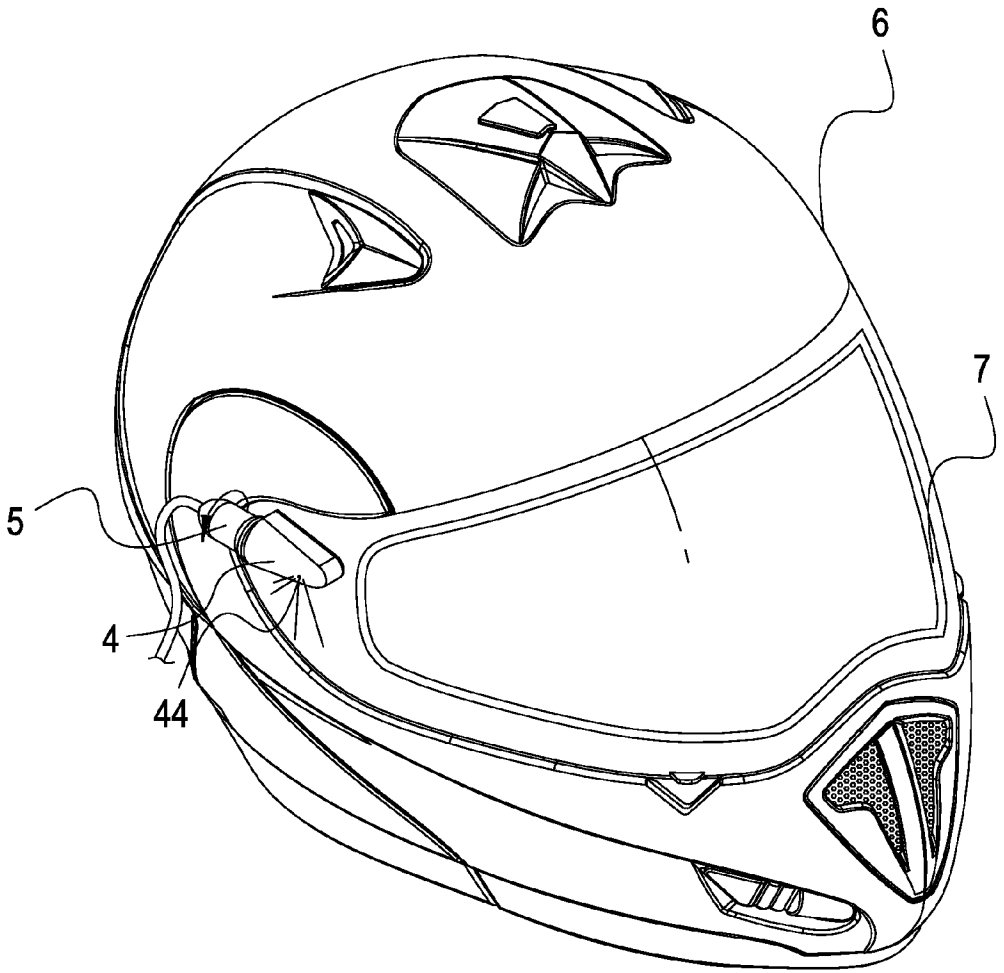
FIG. 4C is a view illustrating an embodiment thereof mounted within a socket on a helmet's surface.

Referring next to FIG. 4A, FIG. 4B and FIG. 4C, an electrical energy supply indicator for helmet according to the principle of the present invention is disclosed, and it can be known from the figures that the indicator 4 is lockably secured on a helmet 6 for its use, and a strip of electrical heating wire mesh 7 is placed surrounding the visor surface 61 of the helmet 6, where the strip is used to provide heat converted from the offered electrical energy, to melt snow and ice on the visor surface 61 of the helmet 6, which can thereby prevent low visibility for the user as a result of accumulated rain and snow condensed on the visor surface 61 of the helmet 6. In this sense, the electrical heating wire mesh 7 of the helmet 6 can serve to effectively reduce occurrence of accidents resulting from interfered driving condition as caused by the rain or snow. Furthermore the electrical energy supply indicator 4 is used to display whether the electrical heating wire mesh 7 is electrically powered, if the mesh is so powered, the light-emitting diode 44 will proceed to light up for display practice.

From the foregoing description, it will be appreciated by a skilled artisan that the present invention makes available the following advantages wherein:

1. The present invention can remain functional to accurately show if the electrical heating wire mesh inside the helmet visor is receptive to the provided electrical energy even if the indicator is subject to multiple rotational disturbance from connecting with the male terminal pin.

2. With the present invention, the movement of the female terminal socket is stabilized when the interconnected male terminal pin is moving about, thereby avoiding short-circuit or disconnection or similar problem at the female terminal socket, and also avoiding breakage or joint disconnection of the cable lines or welding joints at the electrical resistor or at the male terminal pin with other work piece in the product assembly.

The preferred embodiment described above is provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An electrical energy supply indicator for helmet, comprising:

a casing, which has a storage chamber, a receiving channel and an aperture, wherein the storage chamber has a compartment plate, and there is at least one positioning groove constructed on the periphery of the receiving channel;

a female terminal socket, which operates to connect with a male terminal socket, the female terminal socket has a pin receiving member, an article locking member, an anode terminal and a cathode terminal, wherein the pin receiving member of the female terminal socket passes through the receiving channel of the casing to retain an out-of-the-casing position, the article locking member is sandwiched securely between the compartment plate and an interior surface of the casing;

an electrical resistor, which is located within the storage chamber, wherein a terminal of the electrical resistor is removably connected to an anode terminal or a cathode terminal;

a light-emitting diode, which is located within the storage chamber, wherein a first terminal of the light-emitting diode is removably connected to the electrical resistor, and a second terminal of the light-emitting diode is removably connected to an anode terminal or a cathode terminal; and a cover plate, which operates to removably complete a wall of the casing.

2. The electrical energy supply indicator for helmet as recited in claim 1, wherein the female terminal socket is an RCA jack.

3. The electrical energy supply indicator for helmet as recited in claim 1, wherein the male terminal pin is an RCA plug.

4. The electrical energy supply indicator for helmet as recited in claim 1, wherein the article locking member within the female terminal socket has four trapezoidal faces.

5. The electrical energy supply indicator for helmet as recited in claim 1, wherein the cover plate has a slant-faced extrusion block on the underside, the extrusion block of the cover plate operates to superimpose onto a surface of the article locking member with the four trapezoidal faces.

6. The electrical energy supply indicator for helmet as recited in claim 1, wherein the light-emitting diode is packaged with a packaging member, the packaging member is performed to traverse through the aperture on the casing.

* * * * *